US007503171B2

(12) United States Patent
Saito

(10) Patent No.: US 7,503,171 B2
(45) Date of Patent: Mar. 17, 2009

(54) EXHAUST SYSTEM FOR AN INTERNAL COMBUSTION ENGINE

(75) Inventor: Takatoshi Saito, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 173 days.

(21) Appl. No.: 11/580,255

(22) Filed: Oct. 12, 2006

(65) Prior Publication Data

US 2007/0084200 A1 Apr. 19, 2007

(30) Foreign Application Priority Data

Oct. 13, 2005 (JP) ..... 2005-298254

(51) Int. Cl.
*F01N 7/10* (2006.01)

(52) U.S. Cl. ..... 60/323; 60/272; 60/312; 60/313; 60/322

(58) Field of Classification Search ..... 60/272, 60/312, 313, 322, 323, 324
See application file for complete search history.

(56) References Cited

U.S. PATENT DOCUMENTS

| | | | | |
|---|---|---|---|---|
| 4,815,274 | A * | 3/1989 | Piatti | 60/313 |
| 4,939,898 | A * | 7/1990 | Ichimura et al. | 60/274 |
| 6,381,956 | B1 * | 5/2002 | Gilbertson | 60/312 |
| 6,722,126 | B2 * | 4/2004 | Kawamizu | 60/324 |
| 6,837,044 | B2 * | 1/2005 | Kobayashi et al. | 60/323 |
| 6,918,246 | B2 * | 7/2005 | Fukumoto et al. | 60/323 |

FOREIGN PATENT DOCUMENTS

| | | |
|---|---|---|
| EP | 1538315 | 6/2005 |
| FR | 2677077 | 12/1992 |
| JP | 09004451 | 1/1997 |
| JP | 2001082141 | 3/2001 |
| JP | 3405857 | 3/2003 |
| JP | 2004245156 | 9/2004 |
| JP | 2005-315204 | 11/2005 |

OTHER PUBLICATIONS

European Search Report #06255280.7-2311 dated Feb. 6, 2007.

* cited by examiner

*Primary Examiner*—Binh Q. Tran
(74) *Attorney, Agent, or Firm*—Global IP Counselors, LLP

(57) ABSTRACT

An exhaust system for an internal combustion engine having a plurality of cylinders is disclosed. The exhaust system comprises a plurality of exhaust branch passages, an intermediate exhaust pipe section, a partition plate and a downstream pipe section. Each exhaust branch passage is in communication with a respective cylinder. The intermediate exhaust pipe section forms a passage that is in communication with the exhaust branch passages. The partition plate is provided in the intermediate passage and divides the intermediate passage into first and second flow paths. The partition plate further includes a projection positioned on a first surface thereof that is oriented so as to be generally perpendicular to the direction of exhaust flow. The partition plate is disposed within the intermediate passage so as to position the projection in the first flow path.

24 Claims, 5 Drawing Sheets

EXHAUST SYSTEM FOR AN INTERNAL COMBUSTION ENGINE

This application claims priority to Japanese Patent Application No. 2005-298254, filed Oct. 13, 2005, the disclosure of which, including the specification, claims and drawings thereof, is incorporated herein by reference in its entirety.

TECHNICAL FIELD

Described herein is an exhaust system of an internal combustion engine in which a partition plate is provided in an integrating exhaust pipe section to avoid exhaust interference in a multi-cylinder internal combustion engine.

BACKGROUND

As disclosed in Japanese Patent No. 3405857, it is known that in order to avoid exhaust interference inside an integrating exhaust pipe section in an exhaust system in which two or more upstream side exhaust branch passages (pipes) for cylinders are connected to the entrance of the integrating exhaust pipe section, a partition plate is provided along the diameter direction of the integrating exhaust pipe section. For example, in a inline four cylinder internal combustion engine, an exhaust system includes upstream side exhaust branch passages that are joined so as to be in a so-called "4-2-1" form by dividing the inside of the integrating exhaust pipe section into two pathways by the partition plate, connecting upstream side exhaust branch passages for cylinders #1 and #4 to a first pathway, and upstream side exhaust branch passages for cylinders #2 and #3 to a second pathway.

Generally, in such a partition plate provided in the above described integrating exhaust pipe section, an upstream side end portion of the partition plate is fixed to and supported with an upstream side exhaust branch passage (such as pipes). A downstream side end portion of the partition plate, however, includes a non-connected or a free end within the integrating exhaust pipe section. Since the end is free, it tends to vibrate so that undesirable noise may be generated. As may be seen in Japanese Patent No. 3405857, in order to absorb the thermal expansion and heat contraction in a width direction of the partition plate, a curved portion is provided in a longitudinal direction of the partition plate, positioned generally at the center of the partition plate when measured with respect to the width direction. In such a structure, however, the rigidity of the partition plate becomes low and it further tends to vibrate, causing noise.

SUMMARY

The disclosed exhaust system for an internal combustion engine having a plurality of cylinders, comprises a plurality of exhaust branch passages, an intermediate exhaust pipe section, a partition plate, and a downstream pipe section. Each exhaust branch passage is in communication with a respective cylinder. The intermediate exhaust pipe section forms a passage that is in communication with the exhaust branch passages. The partition plate is provided in the intermediate passage and divides the intermediate passage into first and second flow paths. The partition plate further includes a projection positioned on a first surface thereof that is oriented so as to be generally perpendicular to the direction of exhaust flow. The partition plate is disposed within the intermediate passage so as to position the projection in the first flow path.

BRIEF DESCRIPTION OF DRAWINGS

Other features and advantages of the present exhaust system will be apparent from the ensuing description, taken in conjunction with the accompanying drawings, in which.

DETAILED DESCRIPTION

Figure 1:
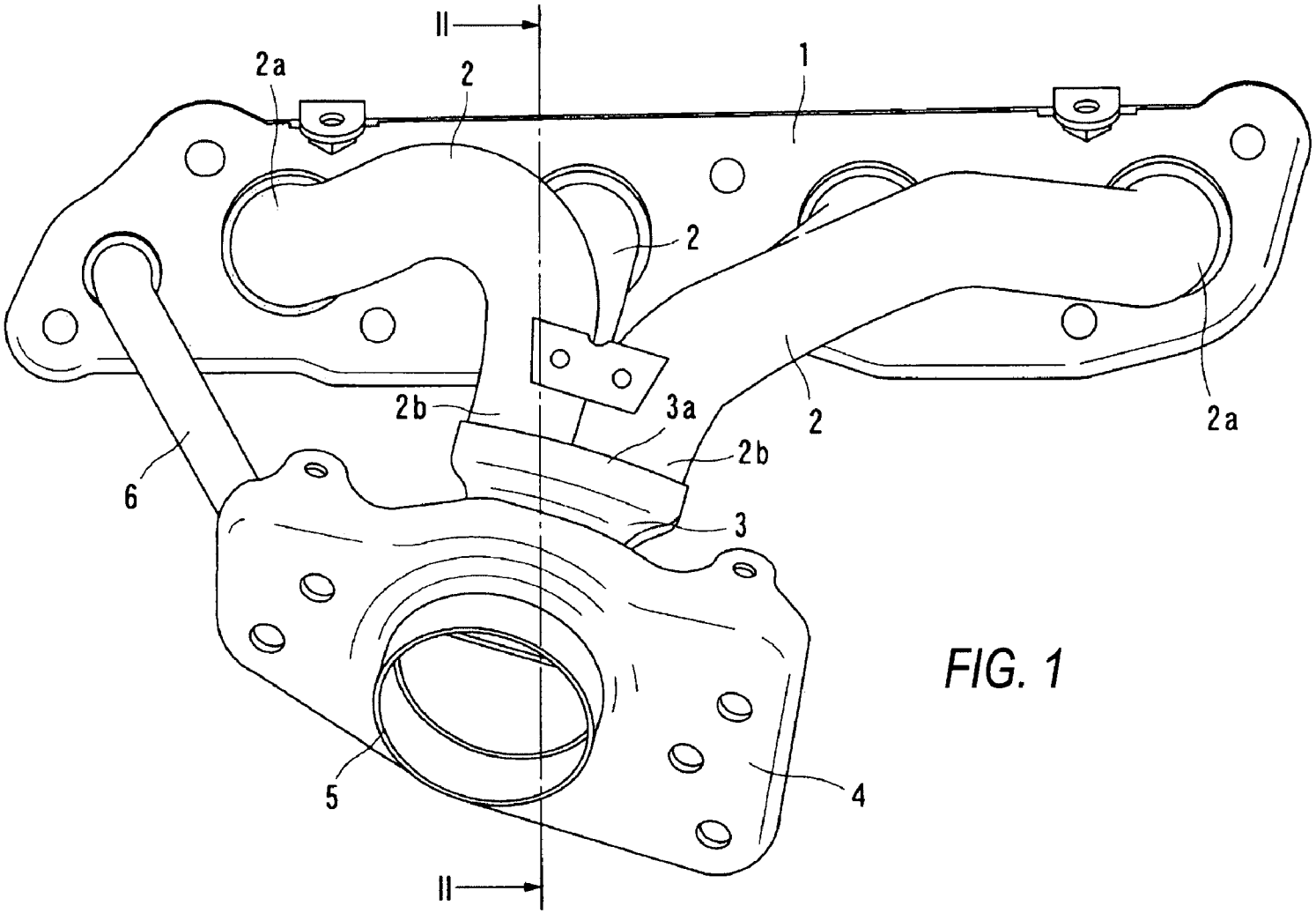
FIG. 1 is a front view of an exhaust manifold for a inline four cylinder combustion engine according to one embodiment of an exhaust system.

While the claims are not limited to the illustrated embodiments, an appreciation of various aspects of the system is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings.

Figure 2:
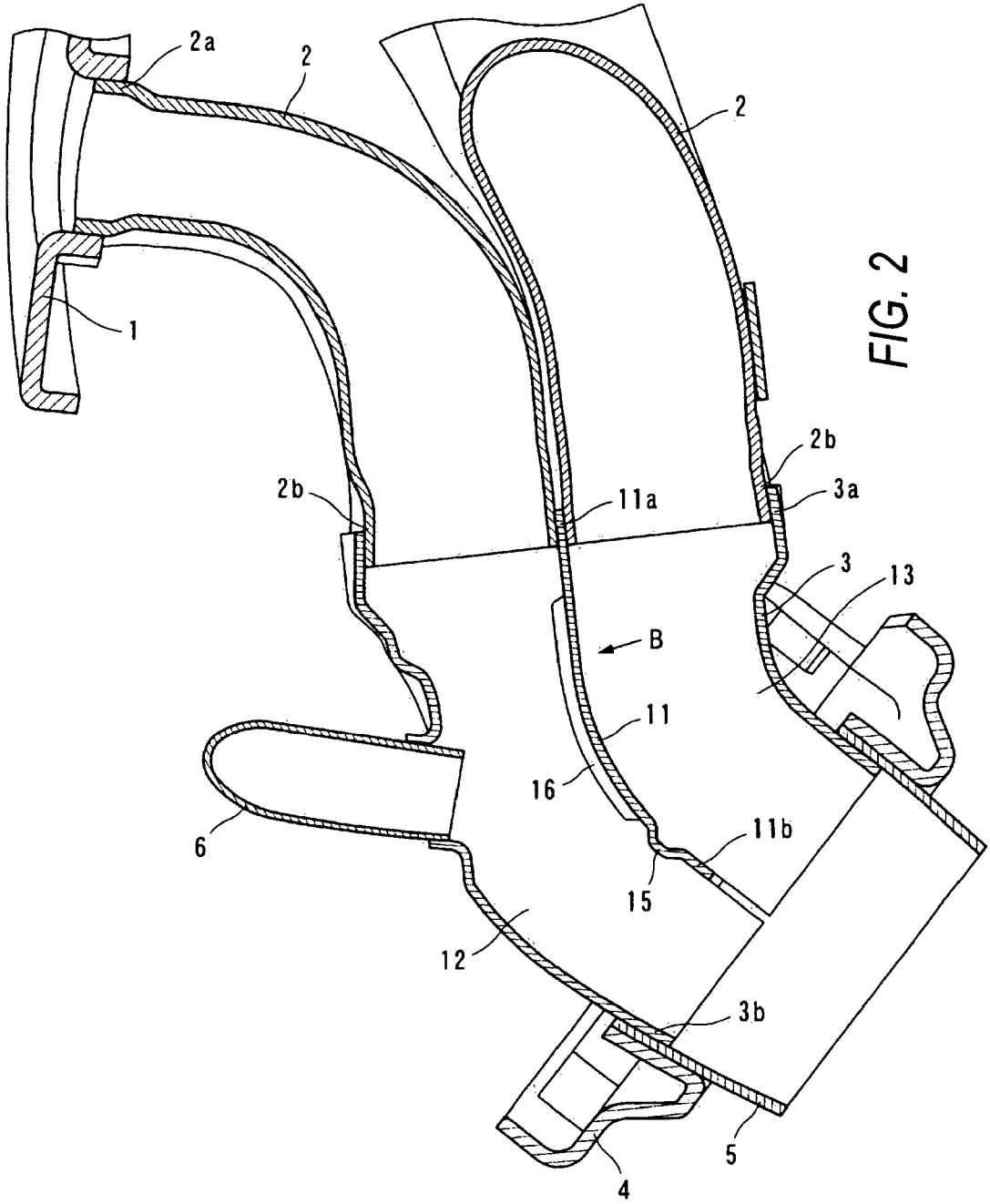
FIG. 2 is a cross-sectional view of an exhaust manifold, taken along line II-II of FIG. 1.

FIGS. 1 and 2 illustrate an embodiment of an exhaust manifold for a inline four cylinder internal combustion engine. An upstream end 2*a* of an upstream side exhaust branch passage 2 (such as, e.g., a pipe) is connected to a cylinder head attachment flange 1. In operation, the cylinder head attachment flange 1 is attached to a side of the cylinder head (not shown). While it is contemplated that each side exhaust branch passage 2 is made from metal, it is also within the scope of the invention that the side exhaust branch passages 2 may be made from material other than metal.

The four (4) upstream side exhaust branch passages 2 shown in the embodiment of FIGS. 1 and 2 extend toward approximately the center of the cylinder line of the exhaust manifold, and downstream side ends 2*b* thereof extend generally in parallel to each other near an entrance of an integrating exhaust pipe section 3. The upstream side exhaust branch passages 2 are combined in a complementary fashion, respectively, and connected and secured to the entrance of the integrating exhaust pipe section 3. For example, in one embodiment, although not specifically illustrated, the downstream side ends 2*b* of the upstream side exhaust branch passages 2 each have a generally quadrant shape in cross-section, respectively, so when the downstream side ends 2*b* are combined in a complementary fashion, the combined downstream side ends 2*b* form a generally circular-type shape in cross-section near the entrance of the integrating exhaust pipe section 3. It is understood, however, that the specific configuration of the exhaust branch passages side ends are not limited to the configuration described above. Once combined, the downstream side ends 2*b* are inserted into and secured to an interior surface of the upstream side end 3*a* of the integrating exhaust pipe section 3. In one embodiment, the downstream side ends 2*b*may be secured to the interior surface side end 3*a* of the integrating exhaust pipe section 3 by welding.

As shown in FIG. 2, when viewed from the front or back of the engine, in one embodiment, the upstream side exhaust branch passages 2 each extend from the cylinder head attachment flange 1 in an approximately horizontal direction, and then curve by approximately ninety (90) degrees downwardly therefrom, so that the upstream side exhaust branch passage 2 is connected to the integrating exhaust pipe section 3. It is understood, however, that the specific curve angle for the upstream side exhaust branch passages 2 is not limited that which is described above and, in fact, may be any angle.

In the representative embodiment depicted in FIG. 1, the upstream side exhaust branch passages 2 for the cylinders #2 and #3 are disposed below the upstream side exhaust branch passages for the cylinders #1 and #4, such that the exhaust branch passages 2 are arranged in an overlapping manner. However, it is understood that the specific positions of the upstream side exhaust branch passages 2 may differ from what is described above without departing from the invention.

As described above, the upstream side end portion 3*a* of the integrating pipe section 3 has an opening, in which the four (4) downstream side ends 2*b* of the upstream side exhaust branch passages 2 are inserted, and the opening faces approximately upward as compared to a downstream side end portion 3*b*. The upstream side end portion 3*a* generally curves toward the engine side. The downstream side portion 3*b*has an opening facing obliquely downward and away from the engine side. That is, when it is viewed from the front or back of the engine, the integrating pipe exhaust section 3 curves in a direction opposite to that of the upstream side exhaust branch passage 2, and as shown in FIG. 2, the exhaust system curves, as a whole, so as to have an approximate S-shape. A flange 4 for attaching a catalytic converter (not shown) to the exhaust system may be attached to the downstream side end portion 3*b* of the integrating exhaust pipe section 3. In detail, this flange 4 has a generally cylindrical section or downstream pipe section 5 which may be integrally formed with the flange 4 and connected to the integrating exhaust pipe section 3. The downstream pipe section 5 is fixedly connected to the downstream side portion 3*b* of the integrating exhaust pipe section 3 so that an inner face of the downstream pipe section 5 fits around the outer circumference of the downstream side end portion 3*b* of the integrating exhaust pipe section 3. The downstream pipe section 5 defines a merged passageway for exhaust flow.

In addition, an end of an exhaust recirculation pipe 6, which is part of an exhaust recirculation passage, is connected to a side surface of the integrating exhaust pipe section 3 on the cylinder head side, and the other end of this exhaust recirculation pipe 6 is connected to the cylinder head attachment flange 1. Moreover, an air-fuel ratio sensor (not illustrated) may be attached to a side face of the integrating exhaust pipe section 3 on an engine front side thereof.

A partition plate 11, which in one embodiment may be formed by press-molding a steel plate, is provided inside the above-described integrating exhaust pipe section 3. The partition plate 11 has, as shown in FIG. 2, a complementary shape, which curves along an axis of the integrating exhaust pipe section 3, and divides the inner space of the integrating exhaust pipe section 3 into a first flow path 12 in which exhaust gas from the cylinders #2 and #3 flows and, and a second flow path 13 in which exhaust gas from the cylinders #1 and #4 flows. An upstream side end portion 11*a* of this partition plate 11 is inserted between the downstream side portions 2*b* of upstream side exhaust branch passages 2 for the cylinders #2 and #3 and the downstream side portions 2*b* of upstream side exhaust branch passage 2 for the cylinders #1 and #4 and is jointly welded therewith. Moreover, a downstream side end portion 11*b* of the partition plate 11 extends to a position adjacent a downstream side end portion 3*b* of the integrating exhaust pipe section 3, which may also be referred to as an outlet edge. Therefore, interference of exhaust gases from the four cylinders joined in the so-called "4-2-1" form that have sequentially ignited, may be avoided. It is understood, however, that the form of the cylinder is not limited to "4-2-1" form but may be other forms, as well.

Figure 3:
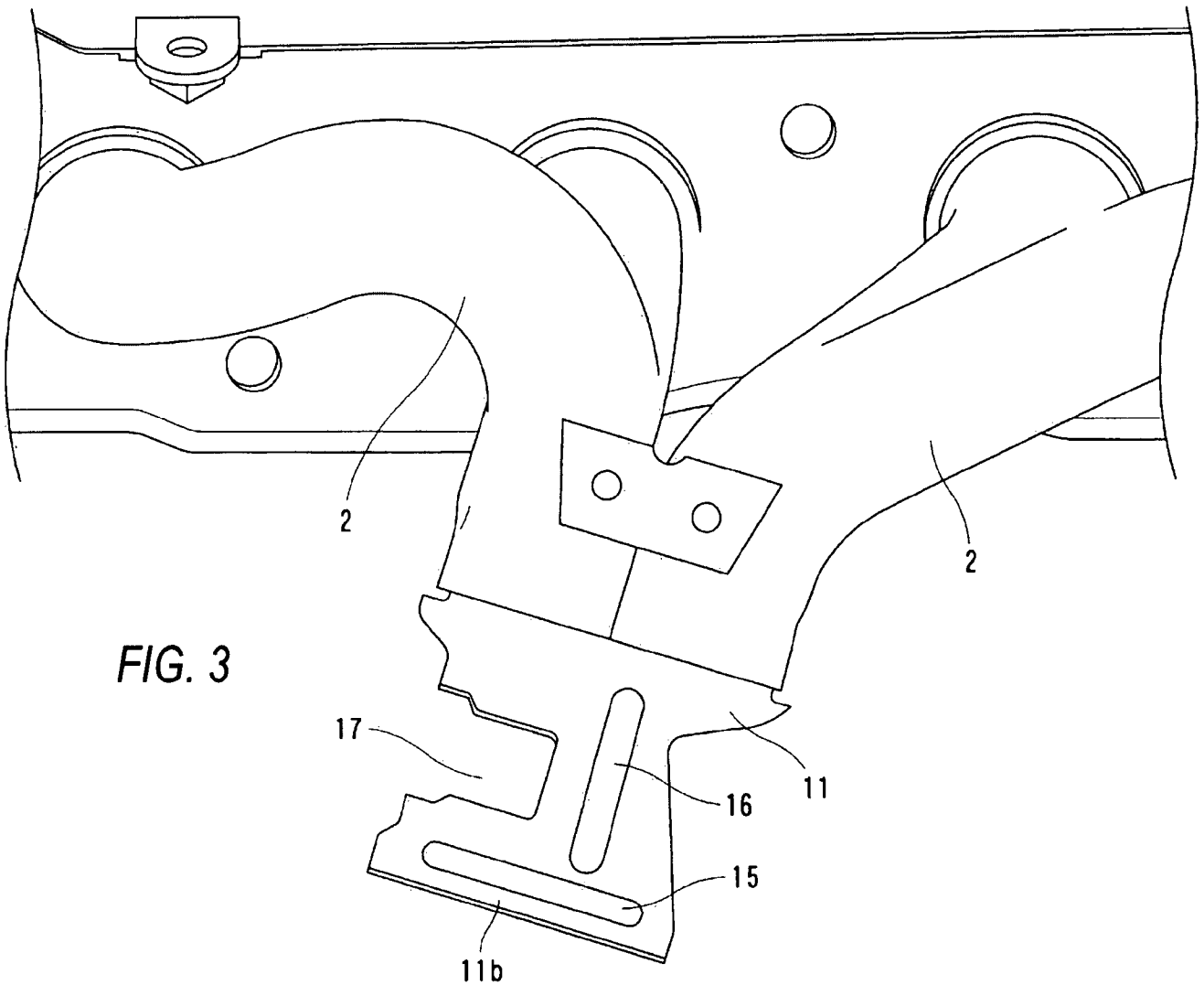
FIG. 3 is a perspective view of an exhaust manifold, viewed in a direction of arrow B of FIG. 2.

A first bead 15 is positioned adjacent to the downstream side end portion 11*b* of the partition plate 11, as best seen in FIG. 3. The first bead 15 extends in a direction that is generally perpendicular to the exhaust flow that flows through the integrating exhaust pipe section 3. The first bead 15 is formed as a projection that extends outwardly from a first surface of the partition plate 11 to minimize vibration. The first bead 15 also serves as reinforcement for the partition plate 11. A second bead 16 extending substantially in the direction of the flow of the exhaust gas may be further positioned on the upstream side of the first bead 15. In one embodiment, first and second beads 15 and 16 are partially deformed or bulged outwardly of the first surface of the partition plate 11 by press-molding the partition plate 11. Further, the partition plate 11 is oriented within the integrating exhaust pipe section 3 such that the first and second beads 15 and 16 are projected into the first flow path 12 which serves as an outside path of the curve portion. In addition, as shown in FIG. 3, in one embodiment, a relatively large cut-out portion 17 may be provided for avoiding interference with the air-fuel ratio sensor (not illustrated) that may be connected in one side edge of the partition plate 11. The second bead 16 is formed adjacent to the cut-out portion 17 at the approximate center of the remaining portion of the partition plate 11. In this embodiment, the first bead 15 is formed over a substantial portion of the downstream side end portion 11*b* of a partition plate 11 in a width direction.

The rigidity of the partition plate 11 increases, and vibration is controlled by integrally forming the beads 15 and 16 into the partition plate 11 by press molding. Since in the primary vibration mode of the partition plate 11, the partition plate 11 tends to have amplitude in a direction perpendicular to the flow of the exhaust, the inclusion of the first bead 15 in a direction perpendicular to the direction of the exhaust flow effectively suppresses the vibration of the partition plate. More specifically, the first bead 15 is formed in a direction that is generally perpendicular to the direction of the flow of exhaust, so that generation of noise due to the vibration can be prevented. The primary vibration mode of the partition plate 11, which has the amplitude in a direction perpendicular to that of the flow, can be effectively suppressed by the first bead 15. A secondary vibration mode of the partition plate 11, which has the amplitude in a direction parallel to that of the flow, can be effectively suppressed by the second bead 16. In addition, since the first bead 15 is provided at least closer to a downstream edge, as compared to the upstream edge, and the first bead 15 is located near the downstream side end portion 11*b* of the partition plate 11, which is a non-connected or a free end, vibration of this downstream side end portion 11*b* is effectively suppressed.

In the embodiment thus described, although there is a possibility that the flow of exhaust may be disturbed by the first and second beads 15 and 16, especially the first bead 15, which is provided in a direction generally perpendicular to that of the exhaust flow, since the first and second beads 15 and 16 are projected in the side of the first flow path 12, influence on the flow can be minimized. That is, since the first flow path 12 in the integrating exhaust pipe section 3 curves, as shown in FIG. 2, the exhaust flows relatively little along the surface of the partition plate 11 because the exhaust flow tends to incline toward the outside of the curve. Therefore, the influence by the projections, that is, the first and second beads 15 and 16, is minimized.

Figure 4:
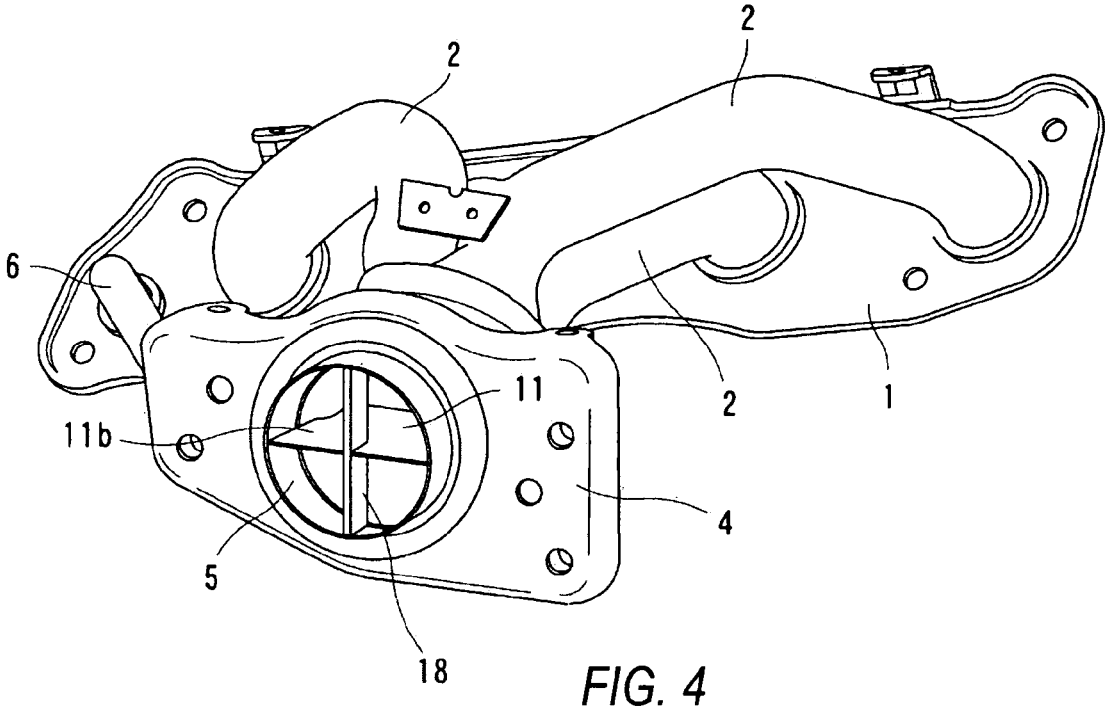
FIG. 4 is a perspective view of an embodiment of an exhaust manifold in which a restraint member is provided.

FIG. 4 shows an embodiment in which a restraint member 18 is provided to more certainly prevent vibration of the downstream side end portion 11*b* of the partition plate 11 and provide support for the partition plate 11. In one embodiment, the restraint member 18 is constructed so as to form an approximately cross shape with the partition plate 11. It is preferred that the restraint member 18 be made from a strip metal plate. It is understood, however, that the restraint member 18 may be made from materials other than the metal.

The restraint member 18 has a recess or slit located generally at its center. Similarly, the partition plate 11 also includes a mating recess or slit located generally at the center of the end portion thereof. The restraint member 18 and the partition plate 11 are assembled together with the slit members of the restraint member 18 and partition plate 11 engaging one another so as to form a cross. After the slit members of the restraint member 18 and the partition plate 11 are secured together to form the cross, the restraint member 18 and the partition plate 11 are welded together, and both ends the restraint member 18 are fixed, such as by welding, to the downstream pipe section 5 which is connected to the integrating exhaust pipe section 3. It is understood, however, that assembly of the restraint member 18 and the partition plate 11 may be accomplished in other suitable manners, without departing from the invention. For example, in another embodiment only one of the restraint member 18 and the partition plate 11 includes a slit. An edge of the other one of the restraint member 18 and the partition plate 11 is received in the slit so has to form the cross-shape for a portion of the assembly along its length.

When the central part of the downstream side end portion 11*b* of the partition plate 11 is fixed to the integrating exhaust pipe section 3 through the restraint member 18 and the downstream pipe section 5 in the manner described above, vibration of the partition plate 11 can be further reduced and/or prevented.

Figure 5:
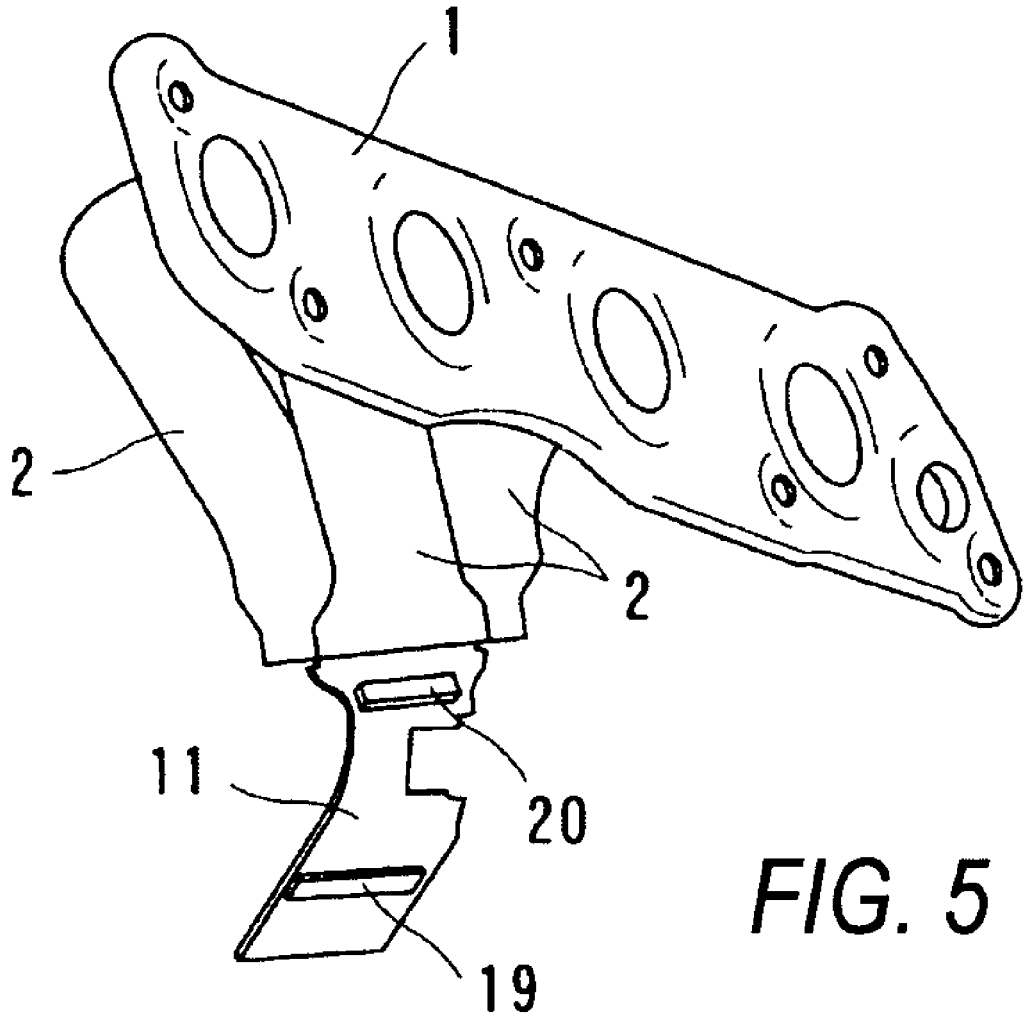
FIG. 5 is a perspective view of a partition plate used in an embodiment of an exhaust system in which the partition plate includes a reinforcement member.

FIG. 5 shows an example in which in place of forming the first and second beads 15, 16 as projections, rod shaped reinforcement members 19 and 20 are fixed to a surface of the partition plate 11. The reinforcement members 19 and 20 may be fixed to the surface of the partition plate 11 by welding or other suitable method of attachment.

Reinforcement members 19 and 20 are attached to an outer surface of the curved partition plate 11, such that the reinforcement members 19 and 20 will be positioned in the first flow path 12. Therefore, the influence on exhaust flow is minimized in the same general manner as in the embodiment mentioned above that included the first and second beads 15, 16. However, in this embodiment, the two reinforcement members 19 and 20 are both provided in a direction that is generally perpendicular to that of the exhaust flow. Further, a cut-out portion, like cut-out portion 17, may be provided between the two reinforcement members 19 and 20.

With reference to FIGS. 1-5, a method of minimizing vibration in an exhaust system having a plurality of cylinders will now be described. First, an exhaust system that comprises a plurality of exhaust branch passages 2 that are each in communication with a respective cylinder is provided. Next, the exhaust branch passages 2 are connected to an intermediate exhaust pipe section 3 that has a predetermined axis that is curved in the direction of exhaust flow.

A partition plate 11 is provided that has a shape that generally corresponds to the axis of the intermediate exhaust pipe section 3. The partition plate 11 is further provided with at least a first projection 15, or 19 positioned on a predetermined surface of the partition plate. The first projection 15 or 19 is oriented in a direction that is generally perpendicular to exhaust flow.

The partition plate 11 is secured within the intermediate exhaust pipe section 3 so as to divide the intermediate exhaust pipe section 3 into first and second flow paths 12, 13, respectively. Further, the partition plate 11 is oriented within the intermediate exhaust pipe section 3 such that the predetermined surface of the partition plate 11 with the at least one projection is facing the first flow path.

Next, the downstream side end portion 3*b* of the intermediate exhaust pipe section 3 is connected to a downstream pipe section 5 that defines a merged passageway therein.

During operation of an exhaust system, exhaust flows from the cylinders through the exhaust branch passages 2 and into the first and second flow paths 12, 13 of the intermediate exhaust passage section 3 that are defined, in part, by the partition plate 11. Vibration of the partition plate 11 caused by the exhaust flow is effectively minimized as the projections 15 and 19 increase the rigidity of the partition plate 11.

The preceding description has been presented only to illustrate and describe exemplary embodiments of the exhaust system according to the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An exhaust system for an internal combustion engine having a plurality cylinders, comprising:

a plurality of exhaust branch passages that are each in communication with at least one of the cylinders;

an intermediate exhaust pipe section forming a passage that is in communication with the exhaust branch passages, wherein the intermediate exhaust pipe section has an axis generally curved in an exhaust flow direction;

a partition plate provided in the intermediate exhaust pipe section, wherein the partition plate is curved to generally correspond to the axis of the intermediate exhaust pipe section, wherein the partition plate separates the passage into a first merged flow path that is in communication with at least two exhaust branch passages and a second merged flow path that is in communication with at least two other exhaust branch passages; and a downstream pipe section which is connected to the intermediate exhaust pipe section and forms a merged passage that is communication with the first and second merged flow paths; and wherein the partition plate has a surface with a first projection projecting from the surface into the first merged flow path, and wherein the first projection extends along the surface of the partition plate in a direction that is substantially perpendicular to the direction of exhaust flow.

2. The exhaust system claimed in claim 1, wherein the first merged flow path is an outside path.

3. The exhaust system claimed in claim 1, wherein the partition plate comprises metal and the projection is integrally formed thereon by press-molding.

4. The exhaust system claimed in claim 1, wherein the projection is formed by a first reinforcement member being attached to the surface of the partition plate and wherein the surface is oriented to face the first merged flow path when the partition plate is positioned within the intermediate exhaust pipe section.

5. The exhaust system claimed in claim 4, further comprising a second reinforcement member that is attached to the same surface of the partition plate as the first reinforcement member and wherein the second reinforcement member is oriented along the surface of the partition plate so as to extend in the same direction as the first reinforcement member.

6. The exhaust system claimed in claim 5, wherein the partition plate further comprises a cut-out portion extending inwardly from an outside edge thereof.

7. The exhaust system claimed in claim 6, wherein the cut-out portion is positioned adjacent the first and second reinforcement members.

8. The exhaust system claimed in claim 1, wherein the exhaust branch passages are formed by a plurality of upstream pipes, and herein an upstream end of the partition plate is fixed to a portion of the upstream pipes, and wherein a downstream end of the partition plate is a free end positioned in the merged passage.

9. The exhaust system claimed in claim 8, wherein the first projection is formed closer to a downstream end of the partition plate than an upstream end of the partition plate.

10. An exhaust system for an internal combustion engine having a plurality cylinders, comprising:

a plurality of exhaust branch passages that are each in communication with at least one of the cylinders;

an intermediate exhaust pipe section forming a passage that is in communication with the exhaust branch passages, wherein the intermediate exhaust pipe section has an axis generally curved in an exhaust flow direction;

a partition plate provided in the intermediate exhaust pipe section, wherein the partition plate is curved to generally correspond to the axis of the intermediate exhaust pipe section, wherein the partition plate separates the passage into a first flow path that is in communication with at least two exhaust branch passages and a second flow path that is in communication with at least two other exhaust branch passages; and a downstream pipe section which is connected to the intermediate exhaust pipe section and forms a merged passage that is communication with the first and second flow paths; and wherein the partition plate has a first projection positioned on a surface thereof such that the first projection is positioned in the first flow path, and wherein the first projection is oriented so as to extend in a direction that is substantially perpendicular to the direction of exhaust flow, and the partition plate further comprises a second projection formed on the same surface of the partition plate as the first projection such that the second projection is positioned in the first flow path, and wherein the second projection is oriented so as to extend substantially in the same direction as the exhaust flow.

11. The exhaust system claimed in claim 10, wherein the partition plate further comprises a cut-out portion extending inwardly from an outside edge thereof.

12. The exhaust system of claim 11, wherein the second projection is located adjacent to the cut-out portion.

13. The exhaust system claimed in claim 1, further comprising a restraint member that supports a downstream end of the partition plate.

14. The exhaust system claimed in claim 13, wherein the partition plate further comprises a first recess formed therein and the restraint member further comprises a second recess formed therein, and wherein the second recess of the restraint member engages the first recess of the partition plate.

15. The exhaust system claimed in claim 13, wherein one of the partition plate and the restraint member further comprises a recess formed therein and an edge of the other of the partition plate and the restraint member is received within the recess.

16. An exhaust system for an internal combustion engine having a plurality of cylinders, comprising:

a plurality of exhaust branch passages communication with the cylinders of the exhaust system respectively, an intermediate exhaust passage section that is in communication with the exhaust branch passages, a partition plate that has a shape that generally corresponds to an axis extending through the intermediate passage section, where the partition plate is provided in the intermediate exhaust passage section to divide the intermediate passage section into first and second flow passages, and a merged passage that is in communication with the intermediate exhaust passage section, wherein the partition plate has a first surface with a first projection projecting from the first surface to extend along the first surface in a direction generally perpendicular to the direction of exhaust flow and the partition plate is oriented such that the first surface is oriented to be facing the first merged flow path.

17. The exhaust system according to claim 16, wherein the first merged flow path is an outside path.

18. The exhaust system according to claim 16, wherein the partition plate has a second projection projecting from the first surface of the partition plate.

19. The exhaust system according to claim 18, wherein the second projection extends along the first surface in a direction that is generally perpendicular to a direction in which the first projection extends along the first surface.

20. The exhaust system according to claim 18, wherein the second projection extends along the first surface in a direction that is generally parallel to a direction in which the first projection extends along the first surface.

21. The exhaust system according to claim 16, wherein the first projection is a bead that is integrally formed in the partition plate.

22. The exhaust system according to claim 16, wherein the first projection is a reinforcement member that is fixedly attached to the partition plate.

23. An exhaust system for an internal combustion engine having a plurality of cylinders, comprising:

a plurality of exhaust branch means that are in communication with the cylinders of the internal combustion engine;

a passage means for delivering exhaust from the cylinders such that the passage means are in communication with the exhaust branch means, and wherein the passage means has an axis that is generally curved in an exhaust flow direction;

a partition means provided in the passage means, wherein the partition means is curved to substantially correspond to the axis of the passage means and wherein the partition means separates the passage means into a first flow path that is in communication with at least two exhaust branch means and a second flow path that is in communication with at least two other exhaust branch means; and a downstream passage means for forming a merged passage that is in communication with the first and second flow paths;

wherein the partition means has a projection means for reducing vibration of the partition means and wherein the partition means is oriented so as to position the projection means in the first flow path, and wherein at least a portion of the projection means is oriented so as to extend in a direction that is substantially perpendicular to the direction of exhaust flow.

24. A method of minimizing vibration in an exhaust system having a plurality of cylinders, comprising:

providing an exhaust system that comprises a plurality of exhaust branch passages that are each in communication with at least one cylinder;

connecting the plurality of exhaust branch passages to an intermediate exhaust pipe section having a predetermined axis;

providing a partition plate that has a shape that generally corresponds to the axis of the intermediate exhaust pipe section, wherein the partition plate is further provided with a predetermined surface with a first projection projecting from the predetermined surface to extend along the predetermined surface of the partition plate in a direction that is generally perpendicular to exhaust flow;

securing the partition plate within the intermediate exhaust pipe section so as to divide the intermediate exhaust pipe section into a first merged flow path and a second merged flow path such that the partition plate is oriented so that the predetermined surface of the partition plate that includes the first projection is facing the first merged flow path; and connecting an end of the intermediate exhaust pipe section downstream of the partition plate to a downstream pipe section that defines a merged passageway.

* * * * *